United States Patent [19]

Iwasaki et al.

[11] 4,223,193

[45] Sep. 16, 1980

[54] DEVICE FOR REPRESENTING STATUS OF PUSH BUTTON SWITCH

[75] Inventors: Sadayoshi Iwasaki; Hiroyasu Miyata, both of Furukawa, Japan

[73] Assignee: Alps Electric Co., Ltd., Tokyo, Japan

[21] Appl. No.: 50,591

[22] Filed: Jun. 21, 1979

Related U.S. Application Data

[63] Continuation of Ser. No. 810,173, Jun. 27, 1977.

[30] Foreign Application Priority Data

Jul. 1, 1976 [JP] Japan ..... 51-86977

[51] Int. Cl.[2] ..... G09F 9/00; H01H 9/16

[52] U.S. Cl. ..... 200/308; 200/340; 116/321

[58] Field of Search ..... 200/308, 340, 56 R; 116/124 L, DIG. 28

[56] References Cited

U.S. PATENT DOCUMENTS

| | | | |
|---|---|---|---|
| 3,769,482 | 10/1973 | New et al. | 116/124 L |
| 3,855,961 | 12/1974 | Schadon | 200/308 |
| 4,031,849 | 6/1977 | Mehta | 116/124 L |
| 4,052,954 | 10/1977 | Roy | 200/308 |

FOREIGN PATENT DOCUMENTS

| | | | |
|---|---|---|---|
| 1436602 | 5/1976 | United Kingdom | 200/308 |

*Primary Examiner*—Willis Little

*Attorney, Agent, or Firm*—Guy W. Shoup; Gerard F. Dunne

[57] ABSTRACT

A device incorporated in a push button switch for representing the status of the switch has a representing plate member having an arm which is rotatably held at its mid portion by a supporting member. The arrangement is such that the sum of the stroke of an operation rod and a rotation of the arm is transmitted to the representing plate member to provide a larger stroke of the later, so as to ensure a distinctive representation for a given stroke of the push button.

1 Claim, 5 Drawing Figures

DEVICE FOR REPRESENTING STATUS OF PUSH BUTTON SWITCH

This application is a continuation of our copending application Ser. No. 810,173 filed June 27, 1977.

BACKGROUND OF THE INVENTION

The present invention relates to a representation device for a push-button type switch.

The invention aims at providing a device of a simple structure and of a low manufacturing cost for representing the status of a push-button type switch.

In a known conventional device for this purpose, as shown in FIGS. 1A and 1B, a push button A is provided with an window section 12 made of a transparent material. A slide groove 14 is provided between an operation rod attaching section 13 and the window section 12, and between the operation rod attaching section 13 and a push-button section. A representing member 17 has one end clamped by a coiled spring retainer 15 and a switch housing 16, and the other end received by the slide groove 14.

As shown in FIG. 1A, the colour, for example black, of the operation rod attaching section 13 appears through the window section 12, in the state of the switch before being operated.

As the switch is depressed to the operating state as shown in FIG. 1B, the end portion of the representing member 17 is moved by a distance corresponding to the stroke of the push button A, and comes to be recognized through the window section. The representing member 17 has a specific colour, for example red, thereby to indicate that the switch has been turned to the operating state.

In this type of representation device, the stroke, or relative distance moved, of the representing member is equal to that of the push button. Therefore when the stroke of the switch is relatively small, it is difficult to provide a distinctive representation using a large area of the window section, resulting in an ambiguous representation.

It is therefore an object of the present invention to overcome the above described shortcoming of the prior art by providing a representation device in which the distance or stroke of the representing member is made larger than that of the push button, thereby to provide distinctive representation.

The above and other objects, as well as advantageous features of the invention will become more clear from the following description of a preferred embodiment taken in conjunction with the attached drawings in which:

DESCRIPTION OF THE PREFERRED EMBODIMENT

Figure 1A:
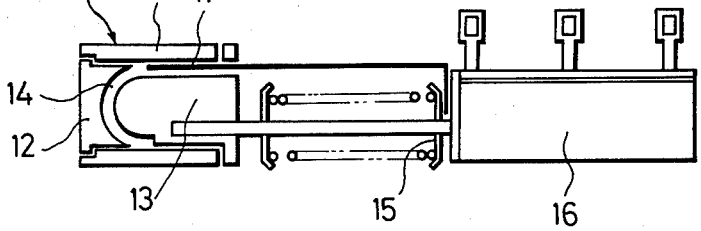
FIGS. 1A and 1B are sectional side elevational views of essential parts of a conventional representation device.
Figure 1B:
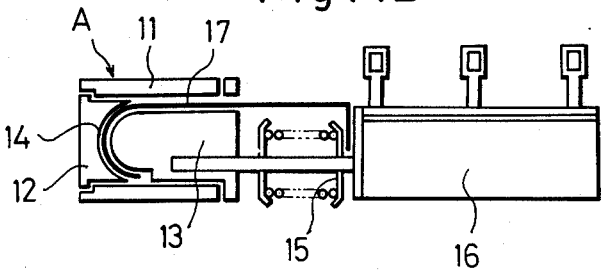
Figure 2:
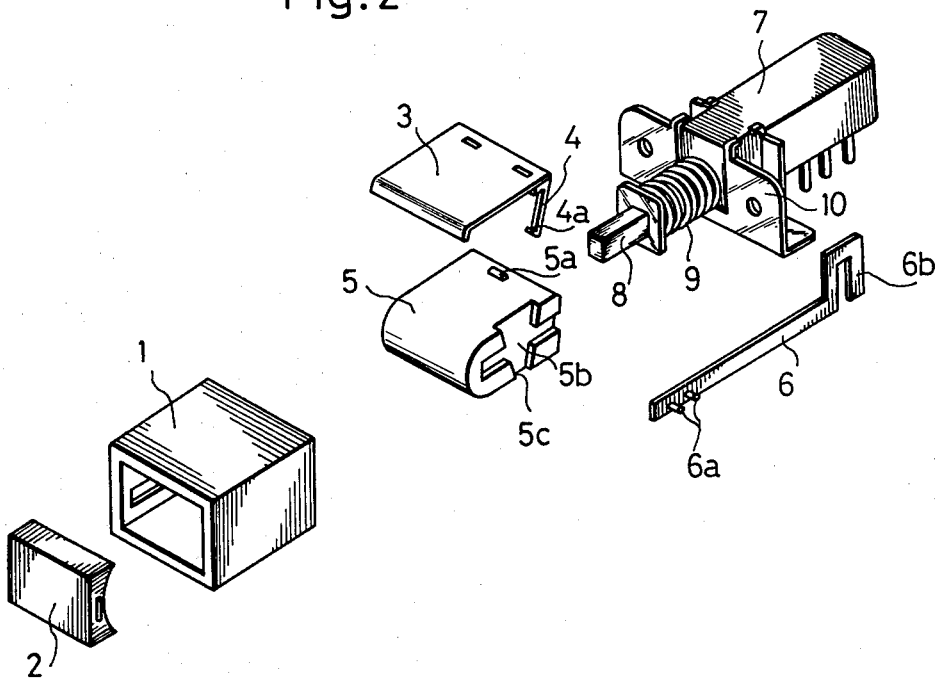
FIG. 2 is an exploded perspective view of an essential part of a representation device in accordance with the present invention.

Referring to the drawings, a push button section 1 is made of a synthetic plastics material and is provided at its one side with an opening to which a transparent window section 2 is to be attached, and with at its other end another opening for receiving an attaching section of an operation rod.

A representing plate member 3 is made of an resilient material and has an arm 4.

The operation rod attaching section 5 has a projection **5*a* and a side wall in which a generally v-shaped groove 5*b* is formed. The projection 5*a* and the groove 5*b* are for attaching to the push button section 1**.

A supporting member 6 is provided with two projections **6*a*,6*a* and a retaining section 6*b***.

Reference numerals 7,8,9 and 10 denote, respectively, a switch housing, an operation rod, a coiled spring and a frame made of a metallic plate.

Figure 3A:
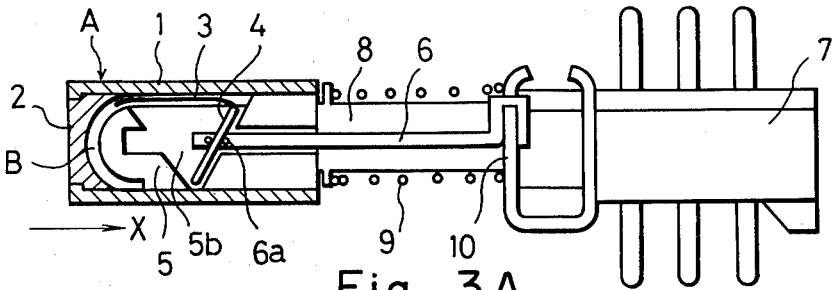
FIG. 3A and FIG. 3B are sectional side elevational views of a representation device in accordance with the present invention explaining the manner of operation of the later.

In operation, referring at first to FIG. 3A showing the switch in the state before the operation, the representing member 3 is received by a groove B constituted by the push button section 1, the operation rod attaching section 5 and the window section 2, and cannot be observed through the window section 2.

In this state, the upper surface of the operating rod attaching section 5 appears through the window section 2.

The projection **4*a* formed at one end of the arm 4 of the representing member 3 is disposed in a bore 5*c* of the operation rod attaching section 5, so that the arm 4 may be pivoted within the groove 5*b* around a fulcrum constituted by the projection 4*a***.

The projections **6*a*,6*a* on the supporting member 6 are in contact with an area near the mid or central portion of the arm 4, while the retaining section 6*b* retains the frame 10**.

As the push button is depressed in the direction of the arrow X from the state of FIG. 3A, the push button A is moved and is accompanied by the operation rod 8, so that one end of the arm 4 on the representing member 3 is also moved in the direction of the arrow X.

However, since the central portion of the arm 4 is clamped by the projections **6*a*,6*a* of the supporting member 6, the other end of the arm 4 where the representing member 3 is attached is moved in the direction of the arrow Y, so as to make the representing member 3 slide within the groove 4, to become positioned aligned with the window section 2** to effect the representation.

The switch has been changed-over within the housing 7, by the motion of the operation rod 8, and has been locked by a locking mechanism (not shown) provided, for example, on the housing 7.

Since the representing member 3 moves along the projections **6*a*,6*a*, and since the push button A itself moves, the stroke of the representing member becomes twice as large as that in the conventional device in which the stroke of the representing plate 3** is equal to that of the push button.

Figure 3B:
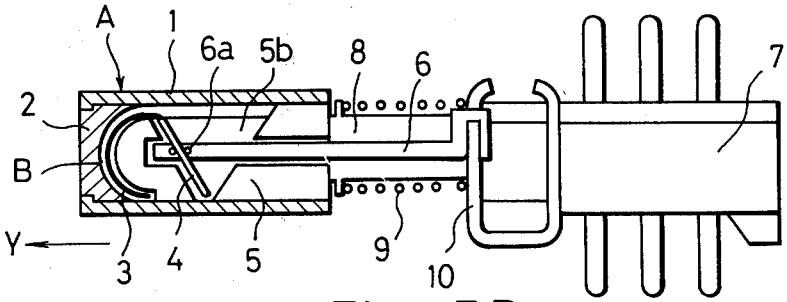

As the push button A is depressed again, at the state of FIG. 3B, the locking is dismissed to cause the reverse movement of the representing member 3, as well as the switch itself, to assume the state of FIG. 3A again.

As has been described, in the representation device of the invention, a representing member having an arm is provided within the switch, the arm being held at almost its central portion by a supporting member secured to the frame or the like, so that the representing member may be moved along a groove to become visible through a window for representing the status of the switch.

Since the representing member has an arm which is supported at its mid portion by a supporting member, the stroke of the representing member becomes sufficiently larger as compared with that of the conventional arrangement, so as to provide practically distinctive representation effect.

What is claimed is:

1. A device for representing the status of a push button switch, comprising:

a hollow push button member having a transparent window at one end thereof;

an attaching member extending within the other end of said push button member and adapted to be attached to an operation rod of said switch;

an elongate representation member comprised of a resilient material and located slidably between an inner surface of said push button member and said attaching member, said representation member having an arm portion held pivotally on said attaching member;

a supporting rod adapted to be secured at its one end to a housing for said switch, the other end of said rod projecting into said push button member and having members formed thereon for holding pivotally a mid portion of said arm portion;

whereby, when said push button member is moved to a first position, said rod will pivot said arm portion and cause forward sliding movement of said representation member to position the forward end portion thereof adjacent said window, and when said push button is moved to a second position, said rod will pivot said arm portion and cause backward sliding movement of said representation member to retract the forward end portion thereof from said window.

* * * * *